US007967037B2

(12) United States Patent
Foster et al.

(10) Patent No.: US 7,967,037 B2
(45) Date of Patent: Jun. 28, 2011

(54) APPARATUS AND SYSTEM FOR DISPENSING LIQUIDS

(75) Inventors: Gordon Brian Foster, Airdrie (CA); Nyanza Alberta Van Vonno, Airdrie (CA)

(73) Assignee: Calgary Scale Services (1988) Ltd., Airdrie (CA)

( * ) Notice: Subject to any disclaimer, the term of this patent is extended or adjusted under 35 U.S.C. 154(b) by 956 days.

(21) Appl. No.: 11/763,095

(22) Filed: Jun. 14, 2007

(65) Prior Publication Data

US 2008/0308178 A1 Dec. 18, 2008

(51) Int. Cl.
*B65B 3/04* (2006.01)

(52) U.S. Cl. ..... 141/104; 141/83; 141/236; 141/372; 222/77; 222/132; 222/135

(58) Field of Classification Search ..... 141/83, 141/100, 104, 236, 372, 374; 222/77, 132, 222/135
See application file for complete search history.

(56) References Cited

U.S. PATENT DOCUMENTS

| | | | | | |
|---|---|---|---|---|---|
| 2,068,646 | A | * | 1/1937 | Hexter | 141/103 |
| 3,878,907 | A | * | 4/1975 | Morick | 141/100 |
| 4,102,366 | A | * | 7/1978 | Puskarz | 141/150 |
| 4,258,759 | A | * | 3/1981 | Achen | 141/100 |
| 4,635,820 | A | | 1/1987 | Marshall | |
| 4,790,456 | A | | 12/1988 | Nakane et al. | |
| 4,967,938 | A | * | 11/1990 | Hellenberg | 141/104 |
| 5,078,302 | A | * | 1/1992 | Hellenberg | 141/104 |
| 5,170,710 | A | | 12/1992 | Harpold et al. | |
| 5,275,100 | A | | 1/1994 | Harpold et al. | |
| 5,474,211 | A | * | 12/1995 | Hellenberg | 141/104 |
| 5,493,840 | A | * | 2/1996 | Cane | 141/104 |
| 5,911,342 | A | * | 6/1999 | Sindoni | 141/104 |
| 5,938,080 | A | * | 8/1999 | Haaser et al. | 141/104 |
| 5,950,874 | A | * | 9/1999 | Sindoni | 141/104 |
| 6,053,219 | A | * | 4/2000 | Seiver | 141/83 |
| 6,550,643 | B1 | | 4/2003 | Foster et al. | |
| 6,585,012 | B1 | * | 7/2003 | Iovino | 141/104 |
| 6,615,881 | B2 | * | 9/2003 | Bartholomew et al. | 141/18 |
| 6,637,471 | B2 | * | 10/2003 | Luehrsen et al. | 141/83 |
| 6,701,977 | B2 | * | 3/2004 | Taylor et al. | 141/83 |
| 6,726,065 | B2 | * | 4/2004 | Sanders | 222/333 |
| 6,883,561 | B2 | * | 4/2005 | Bartholomew et al. | 141/18 |
| 6,886,717 | B2 | * | 5/2005 | Sanders | 222/333 |
| 6,957,672 | B2 | * | 10/2005 | Taylor et al. | 141/83 |
| 6,991,004 | B2 | * | 1/2006 | Kaufhold et al. | 141/83 |
| 7,147,012 | B2 | * | 12/2006 | Kaufhold et al. | 141/11 |
| 7,360,564 | B2 | * | 4/2008 | Engels et al. | 141/83 |
| 7,527,078 | B2 | * | 5/2009 | Driessen et al. | 141/9 |
| 2007/0012376 | A1 | * | 1/2007 | Khoo et al. | 141/87 |

* cited by examiner

*Primary Examiner* — Gregory L Huson
*Assistant Examiner* — Nicolas A Arnett
(74) *Attorney, Agent, or Firm* — Santosh K. Chari; Blake, Cassels & Graydon LLP

(57) ABSTRACT

An apparatus for pumping fluids comprises a suction pump and an inlet tube extendible into a container containing the fluid. A sealing plate is provided over the liquid surface to form a circumferential seal with the inner wall of the container and the outer wall of the inlet tube. The sealing plate prevents air from entering the lower part of the container and thereby prevents the pump from cavitating once the container is emptied. A pumping system is also provided wherein a plurality of pumping apparatuses is provided on a frame. A dispensing system is also provided wherein a plurality of computer controlled nozzles are each connected to a respective pumping apparatus whereby specific volumes of desired fluids can be dispensed.

9 Claims, 8 Drawing Sheets

APPARATUS AND SYSTEM FOR DISPENSING LIQUIDS

FIELD OF THE INVENTION

The present invention relates to apparatuses and systems for dispensing liquids and, more particularly to an apparatus and system for pumping and dispensing viscous fluids.

BACKGROUND OF THE INVENTION

Viscous fluids are commonly used in many commercial applications. Examples of such fluids include thermoplastic materials, lubricants and inks such as plastisol ink. Due to their viscosity, these types of fluids present various problems associated with the pouring and handling thereof.

The dispensing of materials such as plastisol inks, for example, presents various complications. Firstly, these types of inks are normally purchased in containers that need to be emptied into a feed tank of a dispensing apparatus. Such transfer presents a number of problems due to the "sticky" nature of the material. For example, the transfer process is generally time consuming and, due to the high cost of plastisol inks, requires a manual scraping of the containers to minimize loss of material. In addition, once the ink is supplied to a pumping apparatus, the highly viscous nature of the material usually results in inconsistent spurting of the material due to cavitation of the pump.

Various dispensing systems for viscous fluids have been provided in the prior art. Examples of such systems include those taught in the following U.S. Pat. Nos.: 4,635,820; 4,790,456; 5,170,710; and, 5,275,100. However, these prior art devices do not adequately address the above issues.

It is an object of the present invention to provide a fluid dispensing apparatus that addresses some of the deficiencies of known devices.

SUMMARY OF THE INVENTION

In one aspect, the present invention provides a pumping apparatus for allowing a fluid to be pumped directly from a supply container. The apparatus includes a pump and a sealing plate to circumferentially seal the container during the pumping process to prevent cavitation once the container is emptied.

In another aspect, the invention provides a pumping system comprising a plurality of pumping apparatuses.

In a further aspect, the invention provides a dispensing system comprising a plurality of nozzles each connected to a pumping apparatus, wherein each of the nozzles are computer controlled to dispense a desired volume of fluid.

BRIEF DESCRIPTION OF THE DRAWINGS

These and other features of the invention will become more apparent in the following detailed description in which reference is made to the appended drawings wherein.

DETAILED DESCRIPTION OF THE INVENTION

Figure 1:
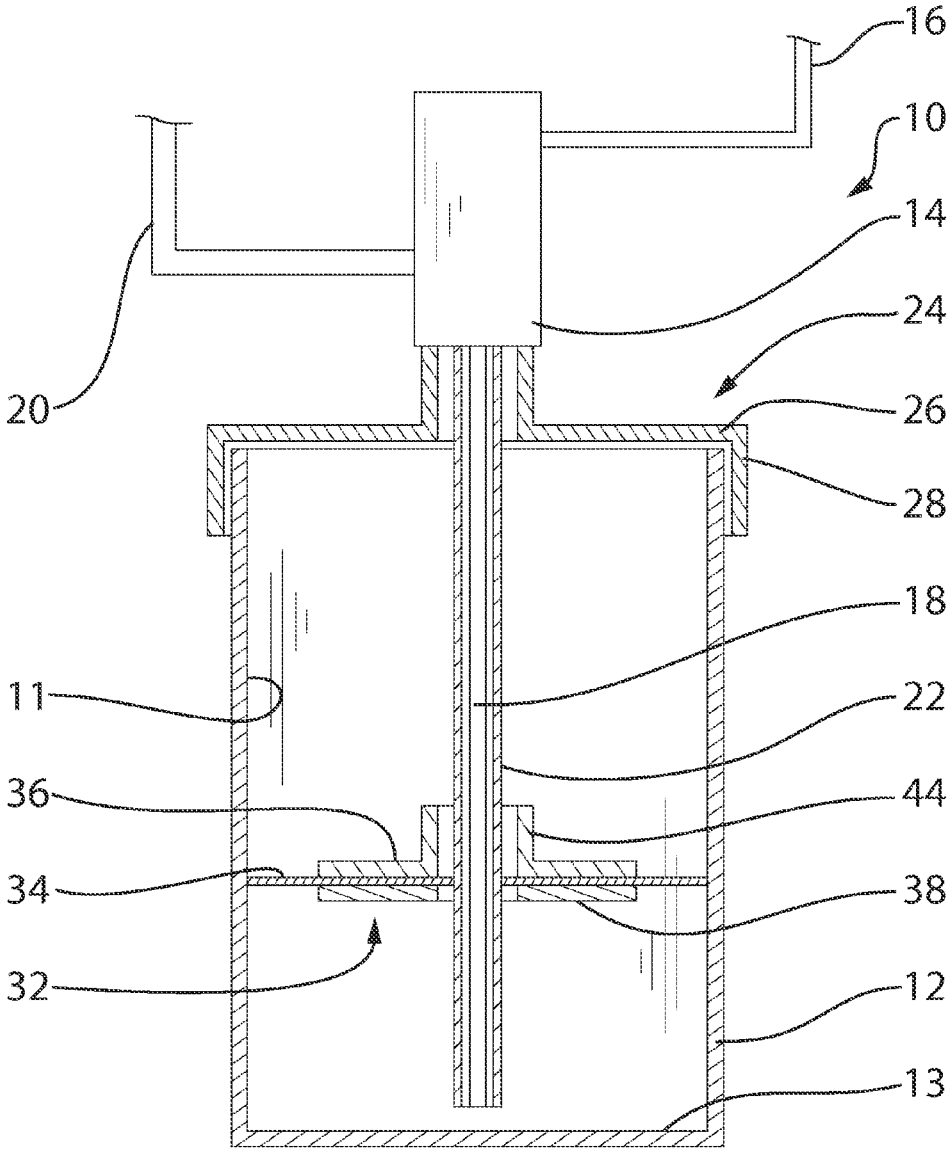
FIG. 1 is cross sectional elevation of a pumping apparatus according to an embodiment of the invention.
Figure 2:
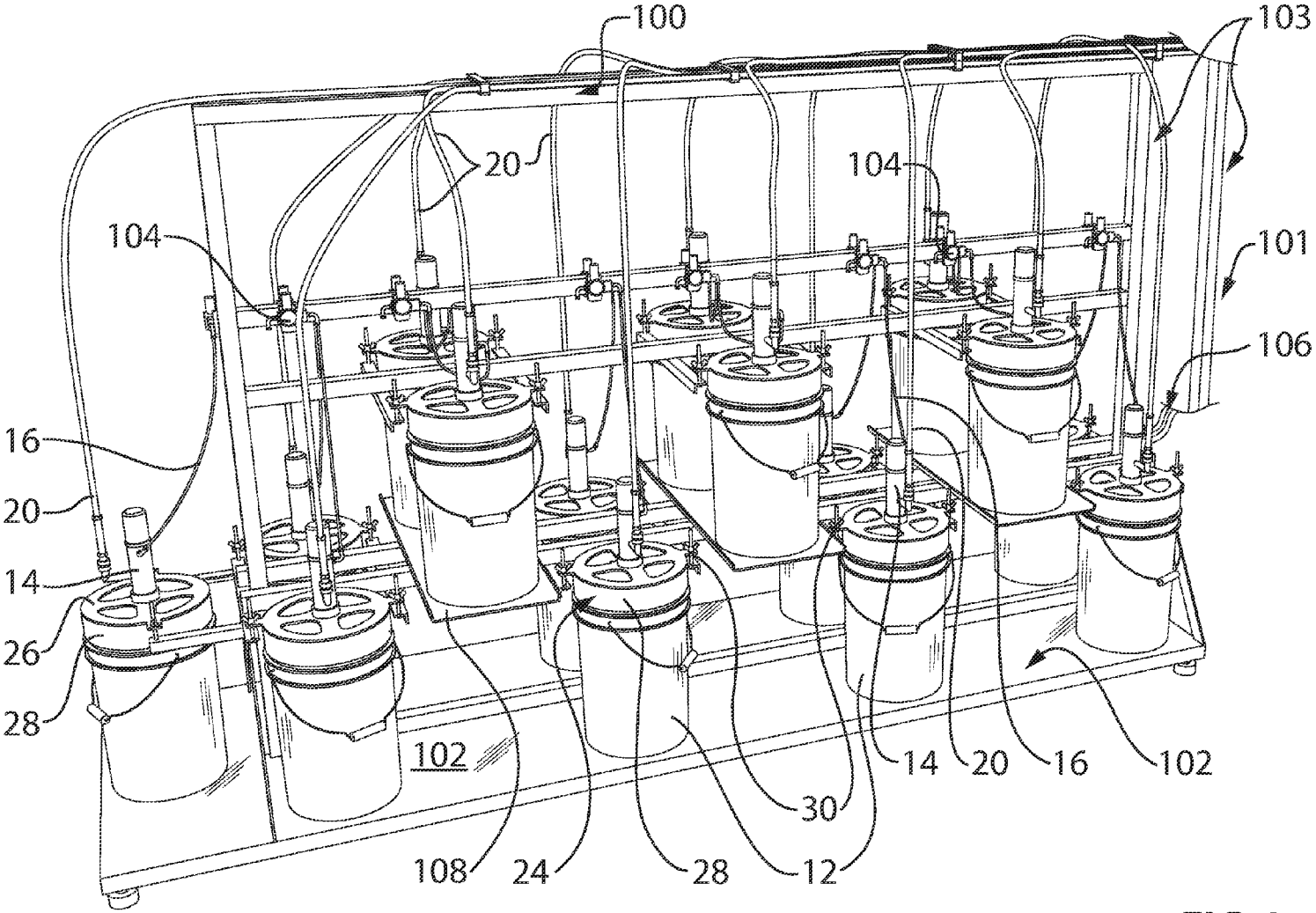
FIG. 2 is a front elevation of a pumping system incorporating a plurality of the apparatuses of FIG. 1.

FIGS. 1 and 2 illustrate an apparatus 10 according to an embodiment of the invention. As shown, the apparatus 10 is provided over a container 12, which provides a supply of liquid, such as a plastisol ink. It will be understood that although the present invention makes reference to plastisol inks, this is merely one embodiment in which the invention can be used and that the invention can be used with various other dispensable fluids. The container 12 includes an inner wall 11 and a base 13.

In the present description, the container 12 will be described as being a standard container in which the desired fluid such as a plastisol ink is purchased. It will be understood, however, that the present invention will be usable with any type of containers.

The apparatus 10 includes a pump 14, which, in one embodiment, preferably comprises a commercially available pneumatic pump. In such case, the pneumatic pump 14 is supplied with a pressure tube or hose 16 connected to a compressor or other such drive means (not shown). The pump 14 is also provided with an inlet tube or hose 18 that extends into the container 12 and an outlet tube or hose 20 through which the ink from the container is pumped. The destination of the ink is discussed further below. The pump 14 is also optionally provided with a sleeve 22 through which the inlet tube 18 extends. In one embodiment, the sleeve 22 is an integral part of the pump 14. In another embodiment, the sleeve 22 may perform the function of the inlet tube 18, thereby obviating the need for the inlet tube 18. Various types and models of pneumatic pumps that can be used with the present invention would be known to persons skilled in the art. Examples of suitable pumps that can be used in the present invention are those manufactured by Graco Inc. (Minneapolis, Minn., USA). In a preferred embodiment, the pumps used in the present invention are provided with a sleeve 22 that functions as the inlet tube thereby avoiding the need for a separate inlet tube 18. It will be understood that the invention will still function in the manner described herein. Various other types of pumps usable in the present invention will be apparent to those skilled in the art.

As shown in FIG. 1, the sleeve 22 and inlet tube 18 extend into the container 12 with the terminal ends thereof extending proximal to the base 13. Since the inlet tube 18 serves to draw fluid from the container 12, it will be understood that such tube, and the sleeve 22, would preferably be positioned above the base 13. However, in the interest of drawing the maximum volume of ink from the container 12, it will be understood that the inlet tube 18 would preferably be positioned as close as possible to the base 13.

The apparatus 10 also includes a support 24 upon which the pump 14 is placed. The support 24 is generally positioned over the opening of the container 12 and, in one embodiment, is adapted to encircle such opening. For example, as shown in FIG. 1, the support 24 includes a plate 26 having a downwardly depending rim 28, when installed on the apparatus. The support 24 is adapted to cover the opening of the container 12 and, therefore, the diameter thereof would be understood as being greater than the diameter of the container. In one embodiment, the support 24 may rest on upper rim of the container 12. However, as described further and as shown in FIG. 2, the support 24 is preferably attached to a frame 100 (discussed further below). To assist in such attachment, the support 24 is preferably provided with one or more flanges 30 (as shown in FIG. 2 and discussed further below) that, in conjunction with a suitable attachment means such as a nut and bolt combination etc., are used to secure the support 24 to the frame 100.

As shown in FIG. 1, the apparatus of the invention also includes a sealing plate 32 that is adapted to float over the surface of the fluid (i.e. ink) in the container 12. As explained further below, the sealing plate 32 is designed to contact the inner surface 11 of the container 12 so as to wipe the fluid material there-from as the fluid level, and therefore, the sealing plate 32, is lowered.

Figure 5:
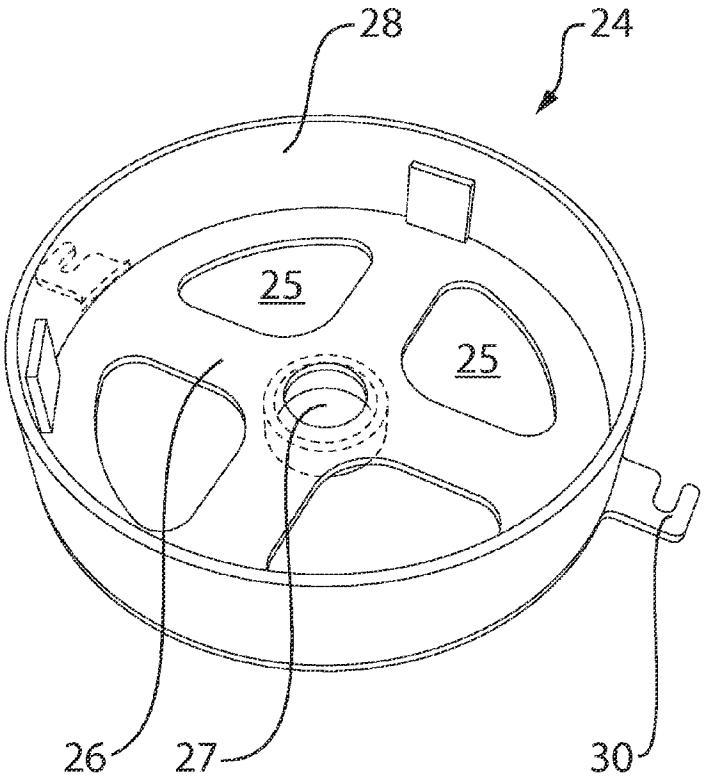
FIG. 5 is a bottom perspective view of the pump support of FIG. 4.
Figure 4:
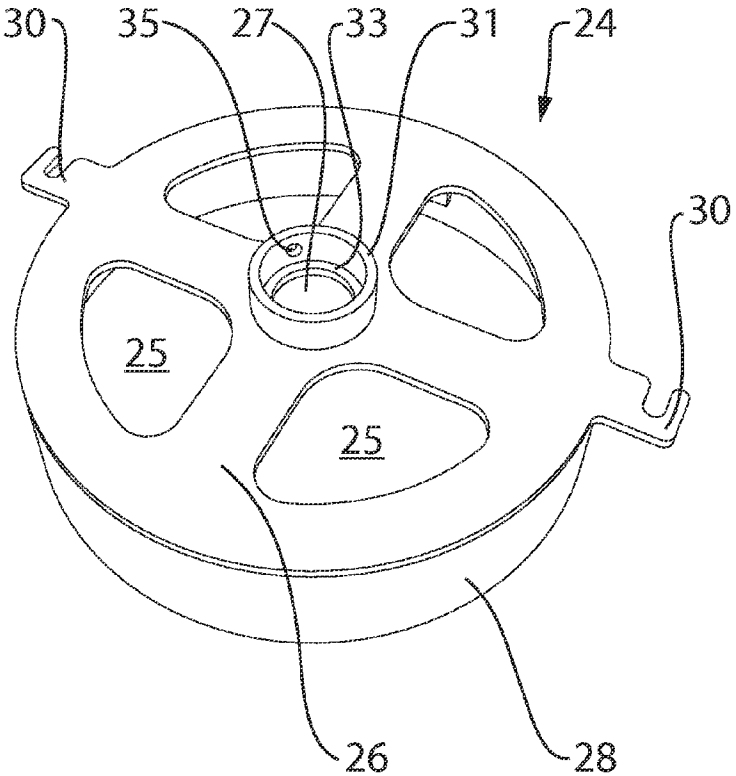
FIG. 4 is a top perspective view of a pump support of the apparatus.

FIGS. 4 and 5 illustrate an example of a support 24 that can be used in the present invention. As shown, the support includes the aforementioned plate 26 and rim 28. The plate 26 preferably includes a number of openings 25 to reduce the weight of the support 24. The support includes an aperture 27 through which extends the sleeve 22. As shown in FIG. 4, the support 24 is preferably provided with a collar 31 extending upwardly from the plate 26. The collar 31 may also be provided with a ledge 33 at the bottom end thereof to receive the pump 14. This provision is made to accommodate cylindrically shaped pneumatic pumps (such as 14 shown herein); however, it will be understood that various other support provisions can be made for other types of pumps. The collar may also be provided with one or more threaded openings 35 to receive retaining bolts (not shown), which assist in retaining the pump 14 and/or sleeve 22 in position.

Figure 7:
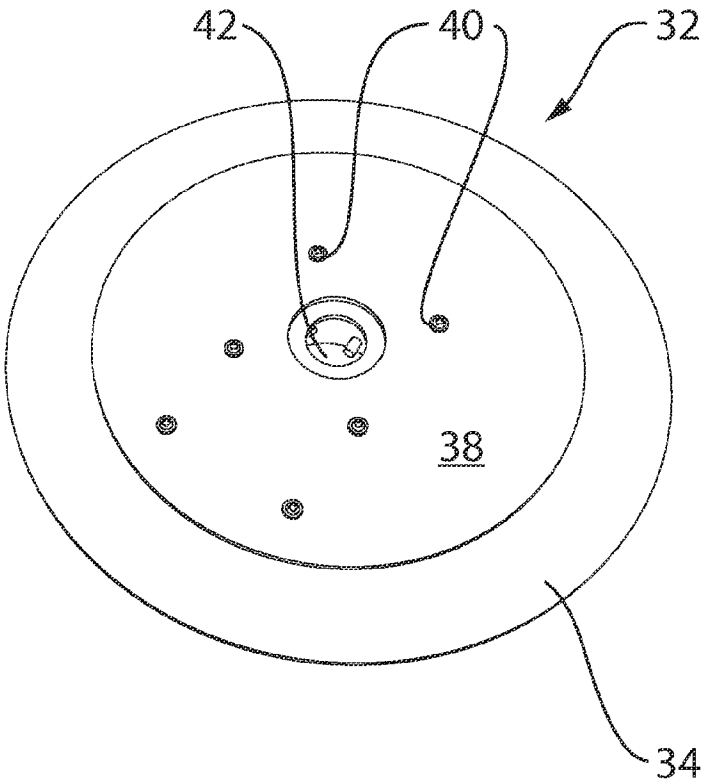
FIG. 7 is a bottom perspective view of the sealing plate of FIG. 6.
Figure 6:
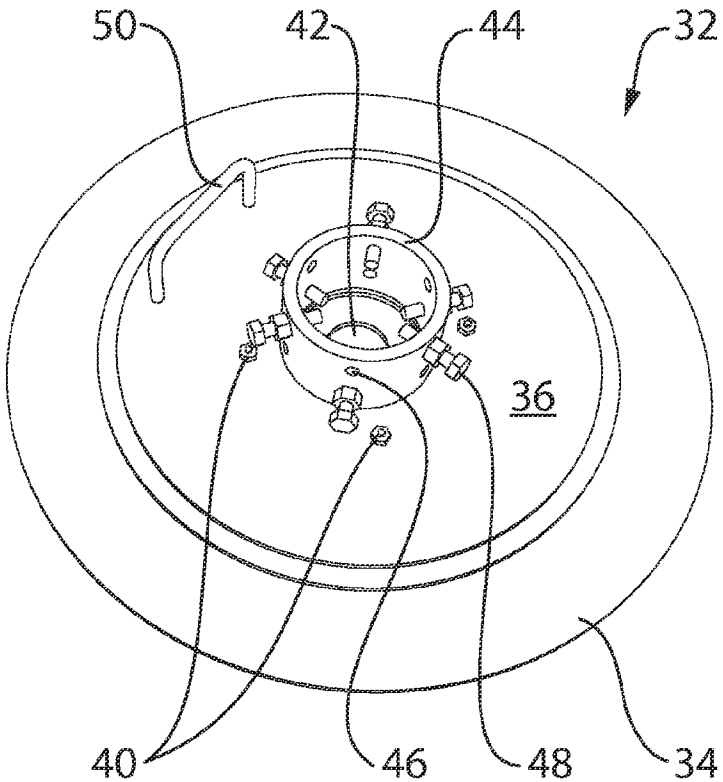
FIG. 6 is a top perspective view of a sealing plate of the apparatus.

FIGS. 6 and 7 illustrate the sealing plate 32 mentioned above. As shown, in one embodiment, the sealing plate 32 comprises a combination of concentrically arranged annular discs. The discs comprise a first, resilient disc 34 that is secured between two rigid discs, namely, upper disc 36 and lower disc 38. The discs, 34, 36, and 38, are secured together by a one or more fasteners 40, such as, for example nuts and bolts. As shown in FIGS. 6 and 7, four fasteners are circumferentially provided in one example; however, it will be understood that the number and type of fasteners 40 will vary depending on the size of the plate 32 and various other factors as will be known to persons skilled in the art. Although the sealing plate 32 has been described in reference to three discs being provided, various modifications thereof will be apparent to persons skilled in the art. For example, in an alternate embodiment, the lower disc 38 may be omitted while still allowing the sealing plate 32 to function in the desired manner. It will be understood that the lower disc 38 is preferably provided to aid in securing the resilient disc 34 and the upper disc 36 together.

The sealing plate 32 is also provided with an opening 42 through which extends the sleeve 22. The sealing plate preferably also includes a collar 44 extending upwardly from the upper disc 36 and over the opening 42. The collar 44 is provided with one or more threaded apertures 46 adapted to receive alignment bolts 48. The bolts 48 serve to align the sealing plate 32 with the sleeve 22 and, in one embodiment, may also assist in securing the plate 32 to the sleeve 22 when the apparatus is not in use. It will be appreciated that any other means may be used to serve the purpose of the alignment bolts 48.

A handle 50 is preferably also provided on the upper disc 36, the purpose of which is discussed below.

As discussed above, the sealing plate 32 is provided above the fluid level of the container 12 and is lowered as the fluid level drops. It will be understood that the density of the sealing plate will be chosen so as to ensure that it does not readily sink within the fluid in the container. However, as will be apparent in the following discussion, the diameter of the resilient disc 34 is selected so that a circumferential seal is formed between the outer edge of the resilient disc 34 and the inner wall 11 of the container 12. Such an arrangement also serves to prevent the plate 32 from sinking. As can also be seen in FIGS. 6 and 7, the inner diameter of the annular resilient disc 34 is less than that of the rigid discs 36 and 38. In addition, such resilient disc 34 inner diameter is preferably sized to be less than the outer diameter of the sleeve 22. By this arrangement, a second circumferential seal is formed between the resilient disc 34 and the sleeve 22. As will be understood the two seals formed by the resilient disc ensure that no air is allowed to enter the container 12 between the fluid and the sealing plate 32. This allows a negative pressure to develop within the fluid thereby forcing the sealing plate 32 to be lowered as the fluid is pumped out of the container. As will be understood, such process is passive thereby removing any need for an external force to be applied to the sealing plate to cause it to follow the fluid level. In addition, the sealing arrangements between the resilient disc 34 and the container wall 11 and the sleeve 22, ensure that both such surfaces are wiped as the sealing plate 32 is lowered, thereby minimizing waste of the fluid.

As shown in FIGS. 6 and 7, the resilient disc 34 is provided with an outer radius that is greater than that of the rigid discs 36 and 38. One advantage of such design is realized when using containers 12 having a tapered side wall wherein the upper diameter is slightly greater than the lower diameter. In such cases, having sufficient clearance between the resilient disc 34 and the rigid discs 36 and 38, will allow the resilient disc 34 to function at any position over the height of the container. It will be appreciated, therefore, that the sealing plate 32 will be sized according to the containers used. In some cases, where a plurality of apparatuses is used, one or more may be provided with differently sized sealing plates.

One of the advantages of the present invention that will be apparent to persons skilled in the art lies in the fact that the pumping apparatus is supported by the support 24 and is connected to the frame 100 by only the pressure and outlet or discharge tubes. Thus, this arrangement will allow the container 12 to be varied in its position without affecting the arrangement of the apparatus. It will also be understood that with this type of arrangement, it is not necessary for the container to be positioned at a specific location as in some prior art apparatuses.

In operation, a container 12 containing the fluid to be dispensed (i.e. a plastisol ink) is opened to expose the fluid surface. An assembly comprising the pump 14, the support 24, the sleeve 22 and the sealing plate 32 is lowered into the fluid within the container 12 until it contacts the fluid surface. As will be understood, in situations where the alignment bolts 48 are used to secure the sealing plate 32 to the sleeve 22 during changing of the container 12, lowering of the sealing plate 32 will require loosening of such bolts in order to lower the plate 32. At this stage, the sealing plate 32 forms a seal between the resilient disc 34 and the container wall 11 and the sleeve 22. The support 24 may either rest directly on the upper rim of the container 12 or may be secured to a frame 100 as discussed herein. The pump 14 is then activated thereby resulting in the pumping of the fluid from the bottom of the container 12. As the fluid is pumped out of the container and the fluid level dropped, the resulting vacuum causes the sealing plate 32 to follow thereby ensuring contact between the fluid surface and the sealing plate 32 to be maintained. This arrangement also prevents entry of air under the sealing plate 32. As will be understood by persons skilled in the art, one of the advantages of this arrangement lies in the prevention of an air space within the fluid thereby avoiding cavitation of the pump 14 once the container 12 is depleted of fluid. As mentioned above, the sealing plate 32 also serves to wipe fluid from the wetted surfaces of the container 12 and the sleeve 22 thereby providing a further advantage of minimizing fluid wastage.

Once the container 12 is depleted of the amount of fluid possible, the pump 14 and support 24 assembly is removed and the sealing plate 32 extracted. The handle 50 would be used to remove the sealing plate 32 from the container 12. In one embodiment, the sealing plate 32 may then be secured to the sleeve 22 by tightening the alignment bolts 48 until a fresh container 12 is provided at which point the above operation is repeated.

Figure 3:
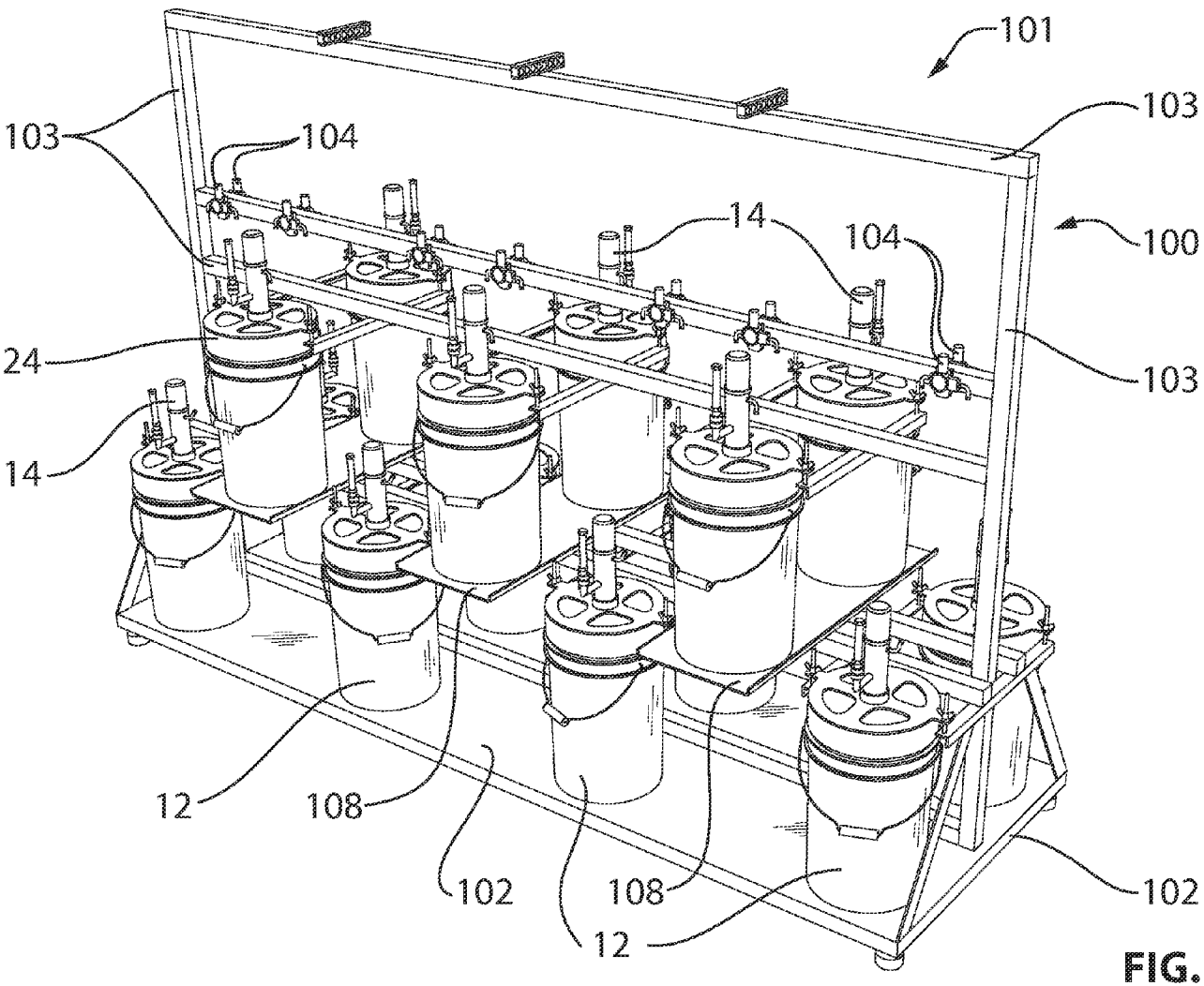
FIG. 3 is a schematic perspective view of the system of FIG. 2 with the connection hoses removed.

It will be understood from, for example, FIGS. 2 and 3, that the above operation can be conducted with a plurality of apparatuses 10 operating either independently or in tandem. In this manner, one or more types of fluids can be dispensed simultaneously. In the case of plastisol inks, for example, the different types of fluids may comprise inks of different colors.

In one embodiment, the apparatus 10 can be provided with a signal means to alert an operator once the container 12 is or is approaching the empty state. It will be understood that such signal means will avoid any damage to the pump 14 as a result of operating with an empty container. In a similar manner, the signal means can include a pump shut off means.

An example of a frame 100 that can be used with the system 101 of the present invention is shown in FIGS. 2 and 3. As shown, the frame 100 generally includes a base 102 and a number of structural members 103, which would be apparent to persons skilled in the art. The frame 100 also includes a plurality of pressure gauges and/or regulators 104, as known in the art, which are attached to the frame and serve to monitor and/or regulate the air pressure supplied to the pumps 14. In the embodiment shown, each pump 14 is connected to a separate regulator 104. Pressure lines 106 (as shown in FIG. 2) connect the regulators 104 to a compressor (not shown). As will be appreciated, by providing a single compressor for driving a plurality of pumps, the invention requires only a single power source, which is advantageous. Nevertheless, it will be understood that the pumps 14 may be driven by one or more compressors as needed. It will also be understood that the compressor is provided in the case where pneumatic pumps are used (as illustrated herein). In the case where other types of pumps are used, it will be understood that the pressure lines 106 and the associated regulators etc. would be replaced by the appropriate drive means.

As also illustrated in FIGS. 2 and 3, the containers 12 are placed on the frame 100 with some resting on the upper surface of the base 102 and with others resting on platforms 108 attached to the frame 100. As illustrated, the platforms 108 are preferably raised above the base 102 whereby the frame 100 is adapted to accommodate a plurality of containers 12. In addition, as shown in FIGS. 2 and 3, the platforms are provided so as to position one or more rows of containers 12 both vertically above and horizontally offset from the containers 12 below. As will be appreciated, such horizontal offset arrangement is preferably so as to allow sufficient clearance of the adjacent pumps 14 and associated hoses without having to raise a row of containers beyond the height of the pumps provided on the lower row of containers. In a preferred embodiment, each of the platforms 108 is adjustable in height so as to accommodate containers of different dimensions.

As also shown in FIGS. 2 and 3, the frame 100 is preferably provided with one or means to secure the tubes and/or hoses used in conjunction with the pumps 14. As will be appreciated, such an arrangement aids in arranging the various parts supported on the frame 100.

As indicated above, FIGS. 2 and 3 illustrate a first system 101 according to an embodiment of the invention. As shown, the system 100 comprises a plurality of apparatuses 10, each pumping a desired fluid through a respective outlet tube 20. Such a system would suffice for the constant supply of a desired fluid or mixture of fluids. As will be understood, each pump 14 of the system 101 can be provided with regulators that are under control by a computer, or simply by a circuit. In this way, one or more pumps can be operated as desired to dispense a fluid or combination of fluids.

The above discussion related to a pumping apparatus and pumping system incorporating such apparatus. In another embodiment, the present invention provides a dispensing system 200 as shown in FIGS. 8 and 9 where elements identical to those described above are indicated with common reference numerals.

Figure 8:
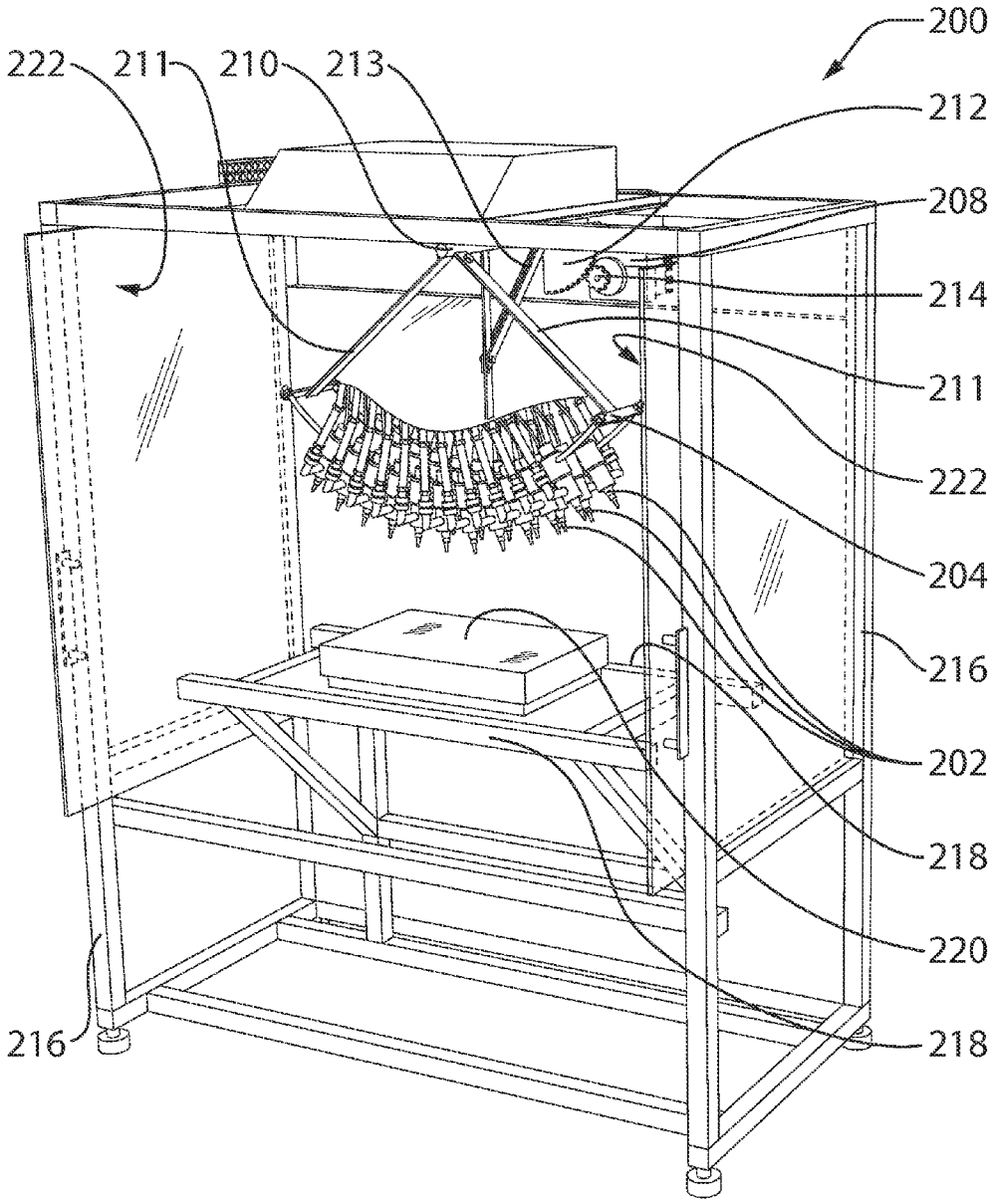
FIG. 8 is a front perspective elevation of a dispensing system according to an embodiment of the invention.

Referring to FIG. 8, the dispensing system comprises a plurality of nozzles 202 provided on a carriage 204. In the preferred embodiment, the carriage 204 is provided with an arcuate shape as shown. The purpose of such shape will be discussed further below.

Each of the nozzles 202 are connected, respectively, to feed lines 206, which comprise the discharge ends of the outlet tubes 20 connected to the pumps 14 of the pumping system 100. The carriage 204 is driven by a drive motor 208 through connecting arms 210 and 211. More specifically, as in the embodiment illustrated in the figures, the carriage 204 is connected to one or more first connecting arms 211, which are, in turn, fixedly attached to a first end of second connecting arm 210. The carriage 204 may optionally be stabilized with a stabilizer bar 213. The opposite second end of the second connecting arm 210 is provided with a sprocket plate 212 that is adapted to engage a gear 214 provided on the rotating shaft of the motor 208. As will be noted, the sprocket plate 212 is preferably arcuate and includes a curvature that is similar to that of the carriage 204. As will be understood, with such a relationship, rotation of motor 208 shaft will result in rotation of the sprocket plate 212 and, thereby rotation of the connecting arm 210 and carriage 204. The purpose of such arrangement will become apparent in the following discussion. It will be understood by persons skilled in the art that the nozzles 202 provided on the carriage 204 are preferably retained in a downward projection. This will prevent any dripping fluid from coating the nozzle and carriage assembly. For this reason, the sprocket plate 212 is not provided as a circular disc since the carriage will preferably not undergo a 360° rotation. In this regard, it will also be understood that the motor 208 will be reversible so as to allow the carriage 204 to be moved from side to side as needed. In a preferred embodiment, the motor 208 will be of a servo type and, as discussed below, will preferably be computer controlled In another embodiment, both the sprocket plate 212 and the carriage 204 can be linear instead of arcuate. It will be understood, however, that such linear arrangement will require the frame 216 to have a larger footprint. As such, the arcuate arrangement described above would be preferable.

Figure 9:
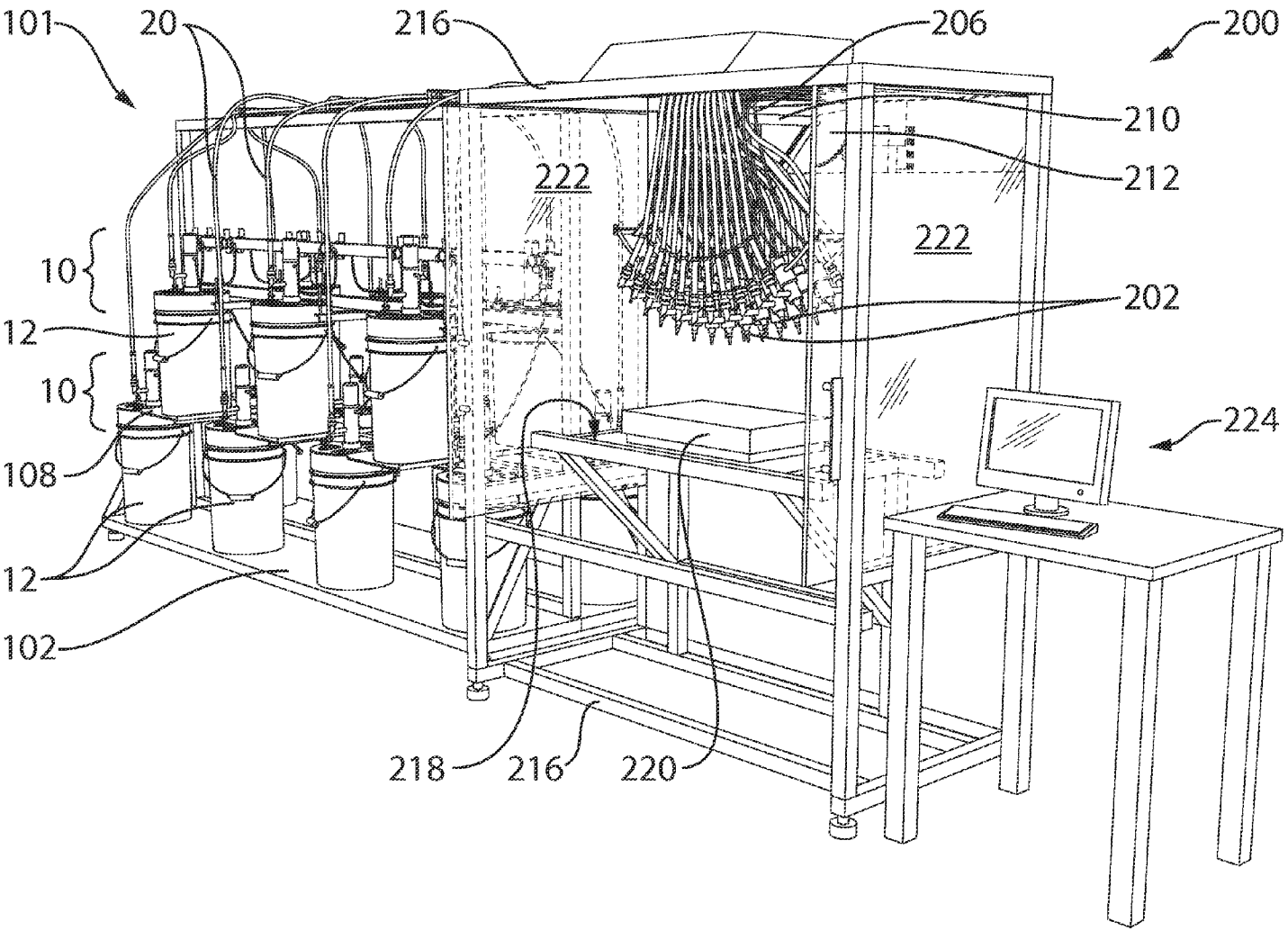
FIG. 9 is a front perspective elevation of the dispensing system of FIG. 8 in combination with the pumping system of FIG. 2.
Figure 10:
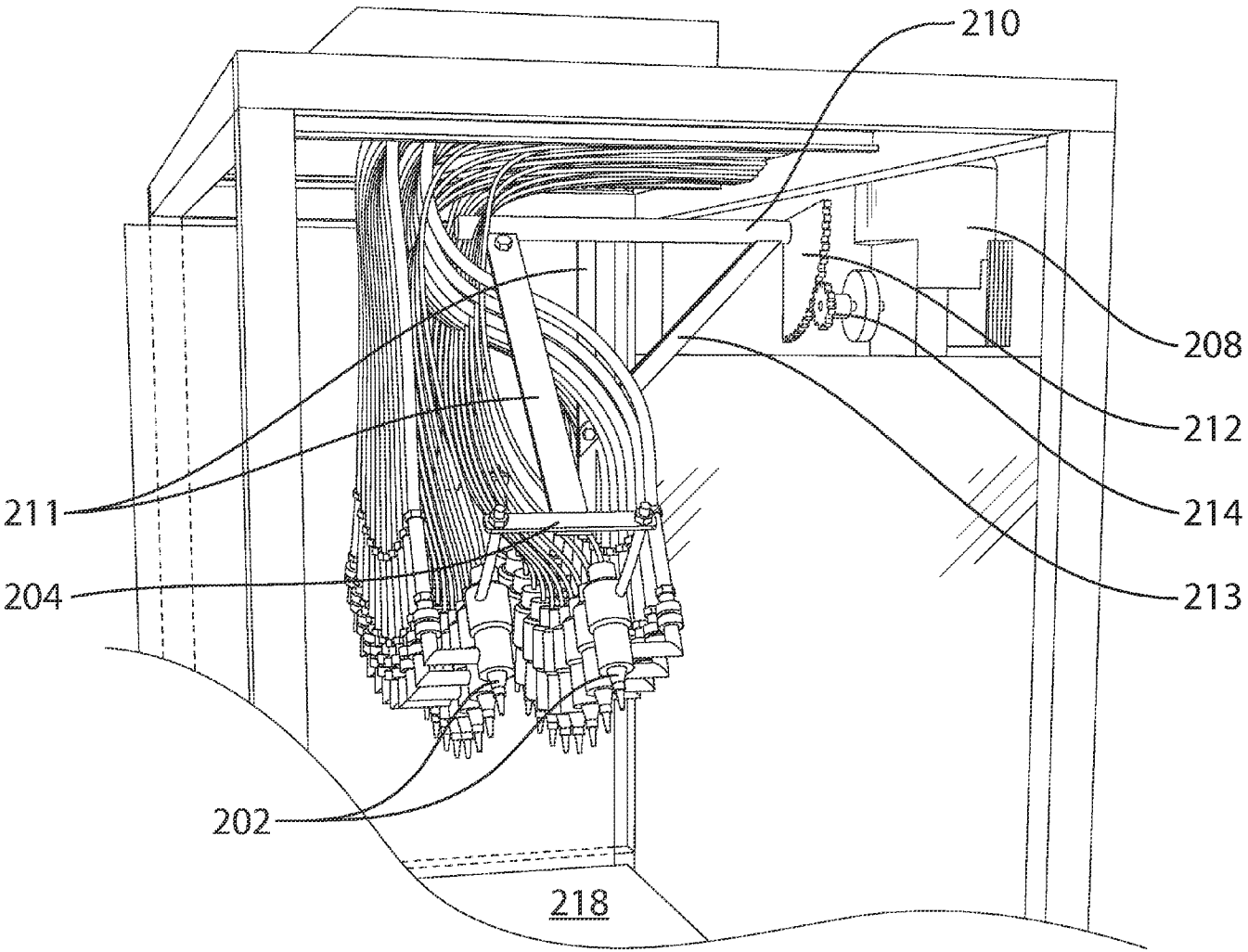
FIG. 10 is a side elevation showing a detail of the dispensing system of FIG. 9.

The above system 200 is preferably provided on a frame 216 as shown in FIGS. 8 and 9. In the preferred embodiment, the motor and nozzle assembly (i.e. the connecting arms 210, 211, the carriage 204 and the nozzles 202 etc.) are mounted generally on an upper end of the frame 216. Such an arrangement is preferable in order to provide for downward dispensing of fluids from the nozzles 202. The base of the frame 216 is adapted to rest on any surface such as the shop floor etc. The frame 216 also preferably includes a table 218 upon which a receiving container (not shown) can be placed. In a preferred embodiment, the table 218 is adjustable in height so as to allow for receiving containers of various heights to be used. In a further preferred embodiment, the table 218 may be provided, either as a separate or integral element, a weigh scale 220. The scale 220 is used to measure the amount of material injected into the receiving container through the nozzles. In order to increase the accuracy of such weight measurement, the frame 216 may be provided with one or more doors 222 to prevent drafts etc. from affecting the weight measurement. In FIGS. 8 and 9, the doors 222 are shown in the open state.

In the preferred embodiment, the operation of the nozzles 202 and the motor 208 are controlled by an appropriate computer control system. In one embodiment, each nozzle is controlled by respective programmable logic circuits (PLC's) (not shown) which, in turn, are directed by a computer 224. The computer 224 will be programmed with suitable control software. The motor 208 can be similarly controlled.

The operation of the dispensing system 200 will now be described. Firstly, it will be understood that the feed lines 206 provide the nozzles 202 with a constant supply of fluid. In the present example, the fluids comprise one or more plastisol inks and, more preferably, inks of different colors. As such, the following description will be provided in terms of such inks. However, it will be understood that any other type of liquid can be used with the present invention.

When a specific mixture of inks is to be prepared, the desired quantities of each ink, i.e. the "recipe", is entered using the computer 224. It will be understood that the operator may enter desired quantities of each ink or may choose from a list of pre-set mixtures. In either case, the computer system 224 directs the respective PLC's to actuate the motor 208 so as to rotate the carriage 204 until the desired nozzle is positioned over the receiving container (not shown). The desired nozzle is then actuated to dispense a specified volume or quantity of the respective ink into the receiving container. After this is done, the carriage is rotated as needed to position the next nozzle over the receiving container and the process is repeated. The amount of dispensed ink can be verified using the optional weigh scale 220. As can be appreciated, the scale 220 may also be connected to the computer 224 to provide feedback to verify the amount of ink dispensed.

In a preferred embodiment, the pumping system 101 and dispensing system 200 are linked so as to provide an integrated pumping and dispensing system. In such case, it will be understood that the computer 224 control system can include control means to ensure that the pumps 14 are operating so as to provide a continuous stream to the feed lines 206. Furthermore, the control system 224 can include programming to control, if needed, the regulators associated with the pumps 14. Such a system would be valuable in situations where fluids of different viscosities are being dispensed and where each pump 14 requires different pressure requirements.

In the above discussion, the various hoses and/or tubes are preferably provided using a "quick connect" linkage system as known in the art. As will be appreciated, such a system enables an operator to more quickly connect or disconnect the hose(s).

Although the invention has been described with reference to certain specific embodiments, various modifications thereof will be apparent to those skilled in the art without departing from the purpose and scope of the invention as outlined in the claims appended hereto. Any examples provided herein are included solely for the purpose of illustrating the invention and are not intended to limit the invention in any way. Any drawings provided herein are solely for the purpose of illustrating various aspects of the invention and are not intended to be drawn to scale or to limit the invention in any way. The disclosures of all prior art recited herein are incorporated herein by reference in their entirety.

We claim:

1. A dispensing system for dispensing a plurality of fluids comprising:
- a frame;
- a motor;
- a carriage assembly attached to said frame and including a drive arm having an arcuate sprocket plate, the sprocket plate being engaged with a driven gear attached to said motor;
- the carriage assembly comprising an arcuate structure, wherein the curvature of the carriage assembly corresponds to the curvature of the sprocket plate;
- the carriage assembly including a plurality of fluid delivery nozzles;
- a plurality of fluid supply lines, each of the supply lines having a discharge end connected to one of said nozzles and an inlet end connected to a pumping system.

2. The dispensing system of claim 1, wherein said motor and said nozzles are computer controlled whereby a select one nozzle is actuated at a given time.

3. The dispensing system of claim 1, wherein said frame includes a weigh scale for weighing the amount of fluid dispensed.

4. The dispensing system of claim 1, wherein the arcuate carriage assembly has a radius of curvature and wherein said radius of curvature lies on a generally vertical plane.

5. The dispensing system of claim 4, wherein the carriage assembly is suspended above a container adapted to receive fluid.

6. The dispensing system of claim 1, wherein the motor is reversible.

7. The dispensing system of claim 1, wherein the pumping system comprises a plurality of pumps, each connected to a respective fluid supply line.

8. The dispensing system of claim 1, wherein said pumping system comprises:
- a pumping system frame;
- a plurality of pumping apparatuses provided on the pumping system frame, each of said apparatuses comprising:
  - a pneumatic pump, the pump including an inlet tube and a discharge tube connected to the inlet end of one of said fluid supply lines;
  - the inlet tube including a rigid sleeve;
  - a support means for positioning the pump; and,
  - a generally annular sealing plate provided coaxially with the sleeve and adapted to form a circumferential seal with the container and the sleeve,
- a drive means for driving said pumps.

9. The dispensing system of claim 8, wherein each of the discharge tubes and the respective fluid supply line are contiguous.

* * * * *